United States Patent [19]

Rünkel et al.

[11] Patent Number: 4,565,524

[45] Date of Patent: Jan. 21, 1986

[54] SEALED YARN HEATING CHAMBER

[75] Inventors: Walter Rünkel, Hückeswagen; Erich Lenk; Karl Bauer, both of Remscheid, all of Fed. Rep. of Germany

[73] Assignee: Barmag Barmer Maschinenfabrik AG, Remscheid, Fed. Rep. of Germany

[21] Appl. No.: 563,300

[22] Filed: Dec. 19, 1983

[30] Foreign Application Priority Data

| | | | |
|---|---|---|---|
| Dec. 18, 1982 | [DE] | Fed. Rep. of Germany | 3247040 |
| Dec. 23, 1982 | [DE] | Fed. Rep. of Germany | 3247626 |
| Feb. 11, 1983 | [DE] | Fed. Rep. of Germany | 3304752 |
| Mar. 9, 1983 | [DE] | Fed. Rep. of Germany | 3308251 |
| Apr. 9, 1983 | [DE] | Fed. Rep. of Germany | 3312823 |
| May 21, 1983 | [DE] | Fed. Rep. of Germany | 3318645 |
| Jun. 11, 1983 | [DE] | Fed. Rep. of Germany | 3321202 |
| Jul. 22, 1983 | [DE] | Fed. Rep. of Germany | 3326432 |
| Oct. 5, 1983 | [DE] | Fed. Rep. of Germany | 3336101 |

[51] Int. Cl.[4] ..... F27B 9/28; F27D 1/18; F26B 13/00; F26B 25/00

[52] U.S. Cl. ..... 432/59; 34/160; 34/242; 432/242

[58] Field of Search ..... 432/8, 59, 242; 34/160, 34/242; 68/5 E

[56] References Cited

U.S. PATENT DOCUMENTS

| | | | |
|---|---|---|---|
| 2,228,272 | 1/1941 | Kinsella | 68/5 E |
| 2,351,110 | 6/1944 | Davidson et al. | 68/147 |
| 2,529,563 | 11/1950 | Miller | 68/212 |
| 2,708,843 | 5/1955 | Gibson et al. | 68/5 E |
| 2,954,687 | 10/1960 | Yazawa et al. | 68/5 E |
| 3,058,232 | 10/1962 | Farkass | 34/242 |
| 3,079,746 | 3/1963 | Field, Jr. | 57/328 |
| 3,298,430 | 1/1967 | Kodaira | 165/104.21 |
| 3,349,578 | 10/1967 | Greer et al. | 34/242 |
| 3,372,630 | 3/1968 | Schmidt | 34/160 |
| 3,796,538 | 3/1974 | Howorth | 432/59 |
| 4,100,660 | 7/1978 | Nemecek et al. | 68/5 E |
| 4,198,835 | 4/1980 | Luthi | 68/5 E |
| 4,226,092 | 10/1980 | Luthi | 62/374 |
| 4,398,386 | 8/1983 | Endo et al. | 57/228 |

FOREIGN PATENT DOCUMENTS

| | | |
|---|---|---|
| 2703991 | 8/1977 | Fed. Rep. of Germany . |
| 2840177 | 3/1980 | Fed. Rep. of Germany . |

*Primary Examiner*—John J. Camby

*Attorney, Agent, or Firm*—Bell, Seltzer, Park & Gibson

[57] ABSTRACT

A yarn heating chamber is disclosed which is adapted for thermally processing an advancing yarn. The chamber comprises first and second members each having a discontinuity in the form of a groove, shoulder or the like in the surface thereof, and the members are movably mounted with respect to each other between an operative position wherein the discontinuities are positioned relative to each other to define a relatively narrow yarn passage, and a threading position defining an enlarged opening to facilitate threading. Also, heating means is provided for introducing saturated water vapor into the yarn passage in the operative position. A pair of longitudinal sealing strips are mounted on at least one of the mating surfaces and extend along opposite sides of the discontinuity, so that in the operative position, the saturated water vapor is adapted to enter into the gap between any non-contacting portions of the surfaces of the members lying between the sealing strips to thereby achieve substantial heat transfer from the condensation of the water vapor.

27 Claims, 27 Drawing Figures

SEALED YARN HEATING CHAMBER

The present invention relates to a heating chamber for thermally processing an advancing yarn, and which is suitable for treating a yarn with a pressurized and hot vapor, preferably with saturated water vapor or steam.

One problem associated with present yarn heating chambers of the described type is the fact that the heating vapor, being under an elevated pressure, escapes through the yarn inlet and the yarn outlet in such large quantities that the operation of the chamber is rendered uneconomical. To alleviate this problem, labyrinth seals and gap seals positioned at the yarn inlet and the yarn outlet are known. Labyrinth seals typically consist of a stack of discs having shutter-like openings, and which form, upon relative movement of the plates, either a wide opening in the threading position, or a labyrinth opening in the operating position, note U.S. Pat. Nos. 4,100,660; 2,529,563; and, 2,351,110. Labyrinth seals are suitable for the threading operation, but they are basically unsuitable in operation, since the necessity of an unhindered yarn travel cannot be achieved by reason of the winding or intricate outlet path which is necessary to avoid losses of the heating vapor. Gap seals are effective in that a long gap length provides a sufficient reduction of vapor loss. However, as the gap length increases and narrows, the threading operation becomes more difficult, particularly in the case of a pneumatic threading of the yarn.

Heating chambers for saturated vapor are known in which the end areas of the heating chambers include a groove extending along the inside surface line, and which are sealed by plugs which are axially inserted into the end area, note German OS No. 27 03 991. In such known heating chambers, threading can be easily accomplished by removing the plugs from the end areas, but when the plugs are inserted, the yarn can be easily damaged since it does not travel at a defined location. Further, it is a significant disadvantage that during the threading operation the plugs cool to an extent such that a uniform operating condition after threading is reached only after some period of time, which results in a correspondingly high amount of waste yarn. Still further, the known heating chamber is costly to manufacture and difficult to operate, and the plug must have a very tight fit in the end of the chamber in order to effect a seal, and the plug tends to freeze in the chamber, particularly during the cooling period.

It has been attempted to correct the above difficulties by providing one component with a thread-groove on a flat surface and a temperature-stable gasket, and which is covered by a heavy lid. It has been determined however that when the heat-chamber is sealed, it is not able to maintain stable operating conditions in the heat-chamber. This instability is characterized by sudden emissions of steam and by temperature variations. At the same time neither the operating temperature nor its uniformity are acceptable.

It is accordingly an object of the present invention to provide a yarn heating chamber which avoids the above mentioned disadvantages of known chambers, and which provides an effective and uniform heating of the components which enclose the advancing yarn, and which does not require close manufacturing tolerances.

These and other objects and advantages of the present invention are achieved in the embodiments illustrated herein by the provision of a heating chamber which comprises a first member including a surface having an elongate longitudinal discontinuity therein, and a second member including a surface which is substantially congruent with the surface of the first member. The two members are mounted for relative movement between an operative position wherein the respective surfaces overlie each other and the discontinuity defines a relatively narrow passage for the yarn, and a threading position wherein the surface of the second member is positioned relative to the discontinuity to define an enlarged opening to facilitate threading of the yarn. A pair of sealing strips are mounted on at least one of the surfaces of the two members, with the sealing strips being disposed on respective opposite sides of the discontinuity in the operating position. Thus in the operating position, the sealing strips are sealably disposed between the surfaces, and the surfaces and the sealing strips define a heating enclosure which includes the discontinity. The heating chamber also includes means for introducing a hot vapor into the heating enclosure when the members are in the operating position, and such that the hot vapor is adapted to enter into the gap between any non-contacting portions of the surfaces of the members lying between the sealing strips, to thereby achieve substantial heat transfer.

By reason of the novel structure as set forth above, the contact pressures which must be applied between the mating surfaces is significantly reduced as compared to prior yarn heating chambers, and the manufacturing tolerances are also significantly less critical. In this regard, it is impossible as a practical matter to manufacture the surfaces with tolerances so precise that there is contact between the entire surfaces. Where there is contact, there is a good heat transfer and equal temperature in both members, and where there is no contact, the resulting gap provides an enclosure into which the hot vapor may enter and condense, to thereby heat the members to an equal temperature. In addition, the contact gap, even under light compression, is sufficiently tight that convection as well as radiation contribute significantly to heat transfer between the metal contact surfaces adjacent the seal, if and to the extent that direct heat conduction does not occur at the point of contact of the sealing surfaces.

By virtue of the present invention, it has became evident that the idea applied previously was in error, namely to provide a lateral tight seal of the thread guide channel, or to provide a lateral seal to compensate for any warping of one component by the other. This is true since the close tolerances called for in the case of metal-to-metal contact would be unattainable due to thermal expension. In the case of sealing by means of a flexible gasket, which of necessity also insulates, a uniform heating of the two components of the heating chamber cannot be achieved. In either case, the heating vapor, and especially the saturated steam, introduced into the chamber containing the thread passage with its restricted surface will not be able to adequately heat the walls of the heating chamber. Consequently, cold spots develop where accumulations of condensate will form, which may then evaporate periodically in an explosive manner.

By means of the sealing construction of the present invention, in contrast to the previously used methods, it is possible to eliminate leaks that can be caused by the introduction of impurities such as thread remnants, dried-on or broken-up fragments, etc., such as are inherent in textile operations. It became evident that in the case of previously used preheating chambers which extend along the thread-groove, not enough heat was available to bring the two solid components surrounding the thread groove to a uniform temperature. However, such uniformity is achievable with the present invention.

The distance between the sealing strips and the thread groove depends on the size of the components that form the heating chambers and which must be heated. The larger the size of the components, the greater should be this distance. In the case of one specific example, the heating chamber comprised a cylindrical inner component surrounded by a cylindrical outer sleeve having a 50 mm diameter, and the distance of the sealing strips from the thread-groove constituted 1/10 of the diameter. The sealing method of the present invention is further characterized in that at least one of the components may be biased by a pressure cushion of heating vapor/saturated steam from the rear. This is particularly advantageous, when the heating chamber consists of an outer sleeve and an enclosed inner cylinder containing the thread passage. In this case both the movable outer sleeve as well as the internal cylinder are heated uniformally on two locations on their circumference.

Also, in accordance with the above embodiment, sealing strips may be provided on the rear side, with a predetermined space between them. The space enclosed by these sealing strips is heated, and in order to provide for contact pressure, this surface area is larger than the one defined by the sealing strips on the yarn passage side, so that contact pressure and heating of both components is effected simultaneously by the heated vapor. As pointed out earlier, the contact between the sealing surfaces of the two components in any event remains so tight that insignificant quantities of steam will escape between the surfaces in the direction of travel by the thread. Nevertheless, at either or both the thread inlet and outlet a transverse seal may be provided. This transverse seal may be formed, for example, by the sealing strips being widened at their ends, so as to extend all the way to or close to the thread passage. In another version the transverse seals are designed as sealing strips into which a thread passage has been cut, which would in any case be brought about by the moving thread, if the sealing strips are made out of a rubber-like substance. In cases where the thread guide groove is part of an insert that is placed into a corresponding insert recess on the component assembly, the groove insert may be provided on both sides with sealing strips. In one advantageous design, the groove inserts are held in place in the insert recesses by means of the sealing strips, which gives the sealing strips a dual function. Furthermore, in this design it is useful and advantageous to apply steam to the insert segments from below, which serves to provide a more uniform temperature distribution along the thread passage.

As previously pointed out, it is preferable for the sealing strips to be made of an elastic material, and they are preferably placed into grooves in one of the housing components that form the heating chamber. The strips should extend slightly above the upper edge of the groove, and preferably, the difference between the depth of the groove (strip recess) and the thickness of the sealing strips should be no greater than the compressibility of the sealing strips under the pressure applied when in operation. Furthermore, the material used in making the sealing strips should be adequately stable when exposed to higher temperatures.

To facilitate replacement, it is recommended that the sealing strips be made out of one piece, and whenever possible in a closed circular shape. In this case it is preferred that the groove of the yarn passage be shaped like a rectangular opening with the shorter sides of the rectangle being located at the points of inlet and outlet of the yarn. Nonetheless, the sealing strips may be formed as rectangles.

In another disclosed embodiment, the heating chamber consists of an inner cylinder and an outer sleeve which encloses the former as an outer jacket. The outer sleeve is composed of two components which are separated along a plane which is parallel to the axis of the bore, and the sealing strips are in the form of flat gaskets disposed between the components. By tightening the two outer components, the sealing gasket is deformed in such a way that its terminal edges lie tightly against the inner cylinder, thus serving as a seal. In this case, the separation plane of the components preferably lies between the axis of the inner cylinder and the yarn passage, so that the terminal edges of the sealing gasket will form sealing strips on both sides of the yarn passage.

In the case of surface variations on either the inner or outer housing, as for example, the presence of a machine thread, it is preferable to place the gasket into the outer housing and after tightening, to then impress the irregularity (e.g. machine thread) into the gasket, so that the latter will conform to the irregularity.

The heating chamber to which the present invention has been applied, consists in every case of two members which, when in operation, contact each other by surfaces (sealing surfaces) that are congruent and that form a sealing joint when they are in contact with each other. At least one of these surfaces evidences a surface irregularity which forms a thread passage which in its cross-section is closed by the other sealing surface. The surface irregularity may be a groove in one of the two members, and in this case the surface irregularity of the other member may also be formed as a groove. The groove may preferably be a line with the housing line or the screw line of an inner cylinder which is enclosed by an outer cylinder as a jacket, in which case the outer cylinder also evidences a groove in line with jacket or screw on its inner surface, which preferably will have a larger cross-section than the first groove. By placing one groove directly over the other at the threading location a larger threading entrance is created. By relative radial displacement of the jacket the thread groove in the inner cylinder is closed up.

One preferred embodiment of the present invention consists of an inner cylinder with groove, and an outer sleeve which is slit along its length. When the slit is in juxtaposition with the groove in the inner cylinder, an insertion gap is formed for an advancing yarn. It should also be noted that the surface irregularities may be in a straight line or curved, so that the yarn is allowed to move freely or in contact with the surface irregularity. The surfaces may also be straight or slightly curved in the direction of yarn travel.

In operation, the yarn heater of the present invention, can be adjusted at the yarn inlet and/or yarn outlet to such a small gap width of, for example, 0.2 to 0.5 mm, that a traveling yarn can be guided unhindered, and that yet the losses of the heating medium are kept low. In particular, in the yarn outlet area, the gap width may vary over the length of the gap.

The two part yarn heating chamber of the present invention can also be provided in the intermediate area of its gap length with recesses, so that the inside width of the gap is widened. This may be useful on one hand, so as to facilitate a certain ballooning of the yarn and/or to avoid or lessen a friction of the yarn on the wall, on the other.

When heating up to more than 100° C., the advantage of heat treating a traveling yarn, in particular, of a multifilament synthetic yarn, with, in particular, a saturated water vapor instead of a highly superheated water vapor or hot air, consists in that the saturated water vapor has a large, latent heat content (heat of evaporation), and that the yarn is highly heated at high yarn speeds and short dwelling times because of the very high heat transfer coefficients at condensation, in contrast to the convection, radiation or direct heat conduction. However, the treatment with saturated vapor also effects a uniform temperature distribution and a good temperature stability over the entire length of the treatment zone. The treatment zone may also randomly consist of several successively arranged treatment chambers, since the required uniformity and stability of the treatment temperature can be ensured for several treatment chambers by adjusting the pressure between the chambers. The losses at the inlet and outlet of the treatment zone can be kept low, and lower than in comparative hot-air heating zones, when the yarn inlet and yarn outlet are designed according to the present invention.

For this reason the saturated vapor treatment chambers of the present invention are particularly suitable, with the simple threadability of traveling yarns as it provided by the invention, for such yarn treatments in which a great amount of heat has to be transferred to the yarn in a relatively short dwelling time, such as is the case, for example, with synthetic fibers which are handled in spinning, spin-drawing, spin-texturing or spin-draw-texturing processes and in draw-texturing, draw-twisting, draw-winding and other draw processes.

It is possible to align several of such yarn heating chambers parallel to each other and to interconnect them by a single supply line for the heating medium, particularly, for the saturated vapor. Throttling losses between the yarn ducts are largely avoided, and a good stability of the obtained yarn temperatures is ensured from one yarn path to the other.

By the same token, several yarns may be run through a single thread passage. Beyond this it is also possible to provide one of the housing assemblies with several surface irregularities, e.g. groove(s), in which case one or more threads may pass through each groove. Such several grooves are then located between two sealing strips that are arranged in turn at some distance from the extreme outer grooves. In one such embodiment, the yarn heating chamber is designed to be double-sided by having a yarn heating passage on each side of a central plate.

Embodiments of the invention are described in conjunction with the drawings, in which.

Figure 3A:
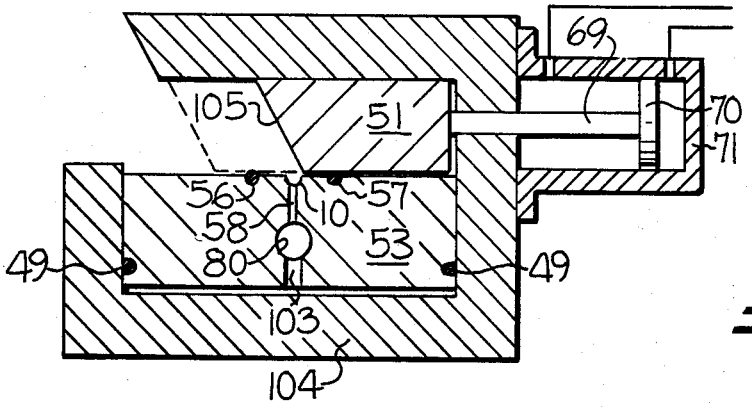
Figure 3B:
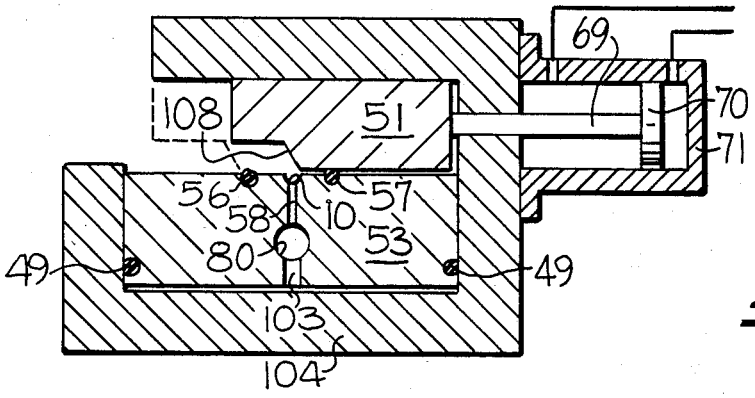
Figure 3C:
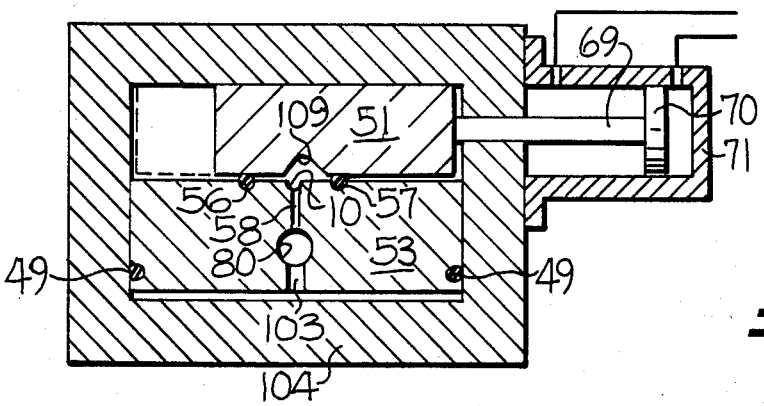
Figure 4:
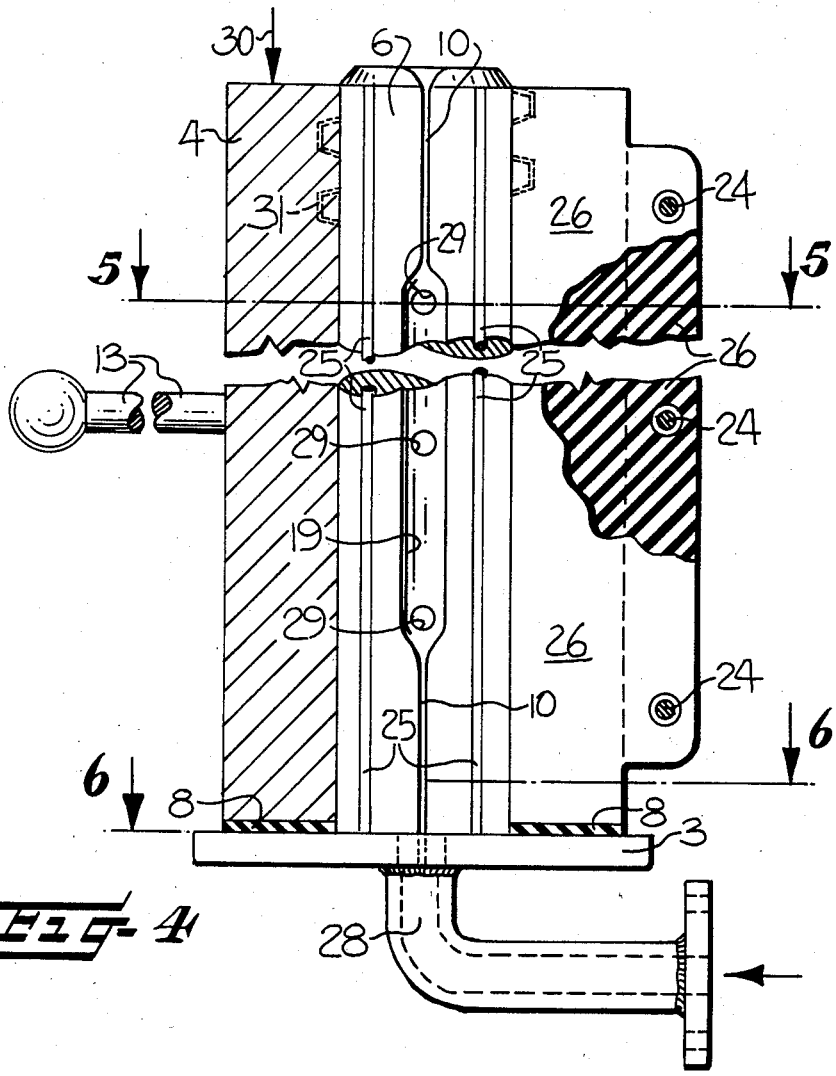
Figure 5:
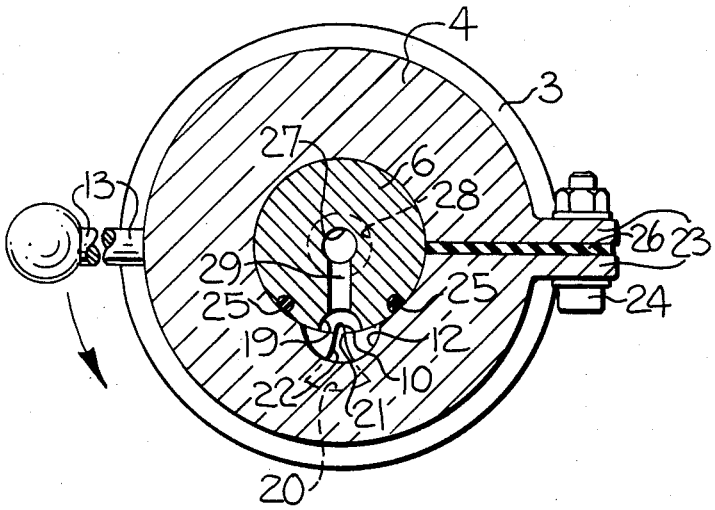
Figure 6:
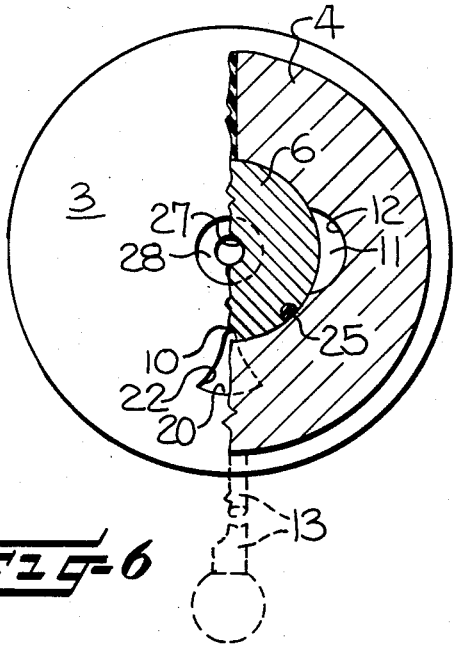
Figure 7:
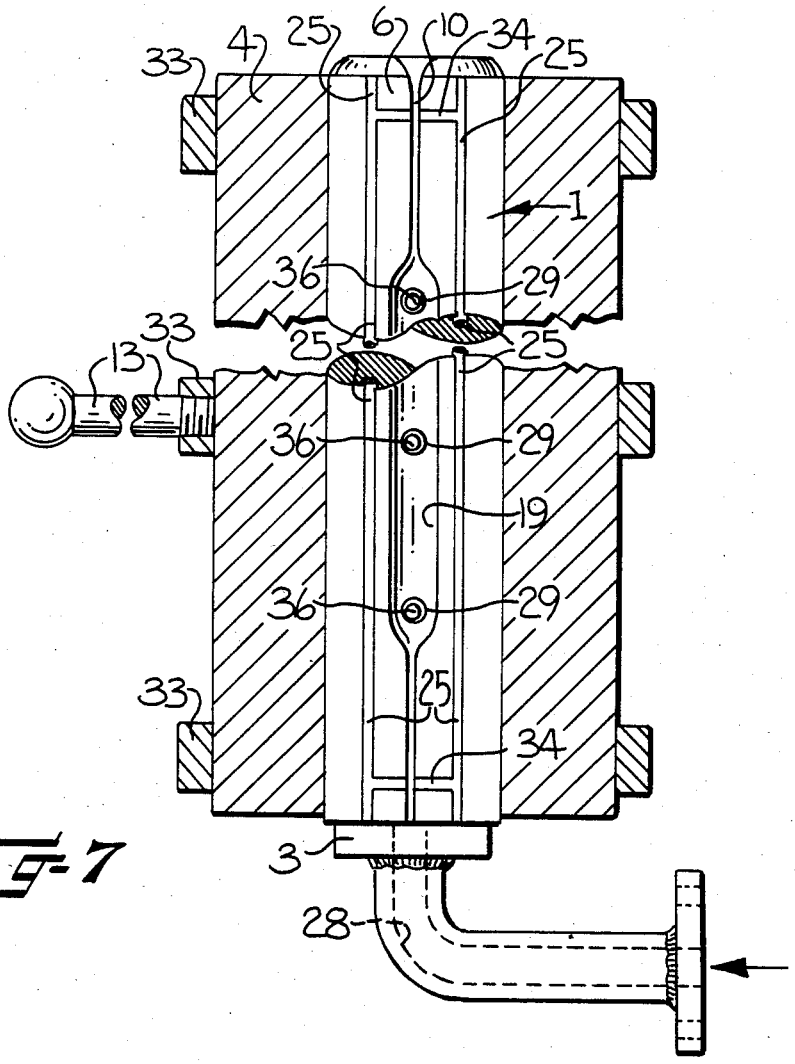
Figure 8:
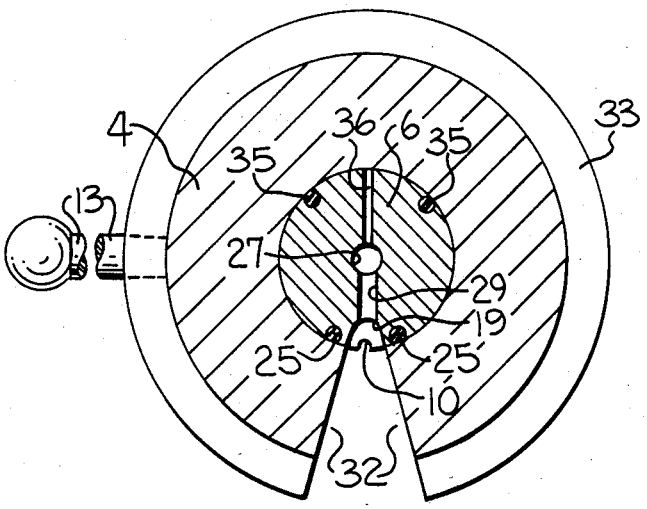
Figure 9:
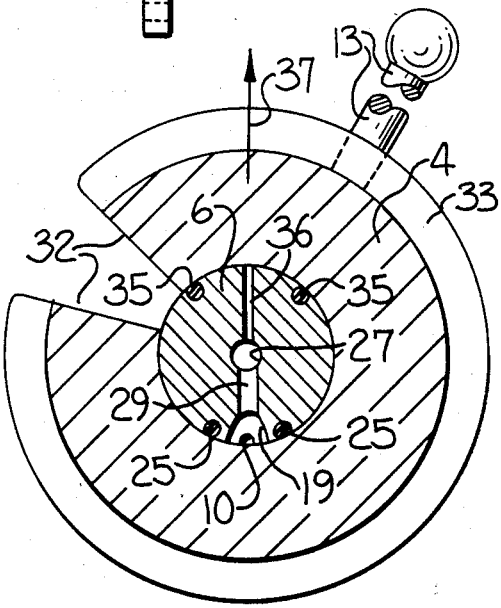
Figure 15:
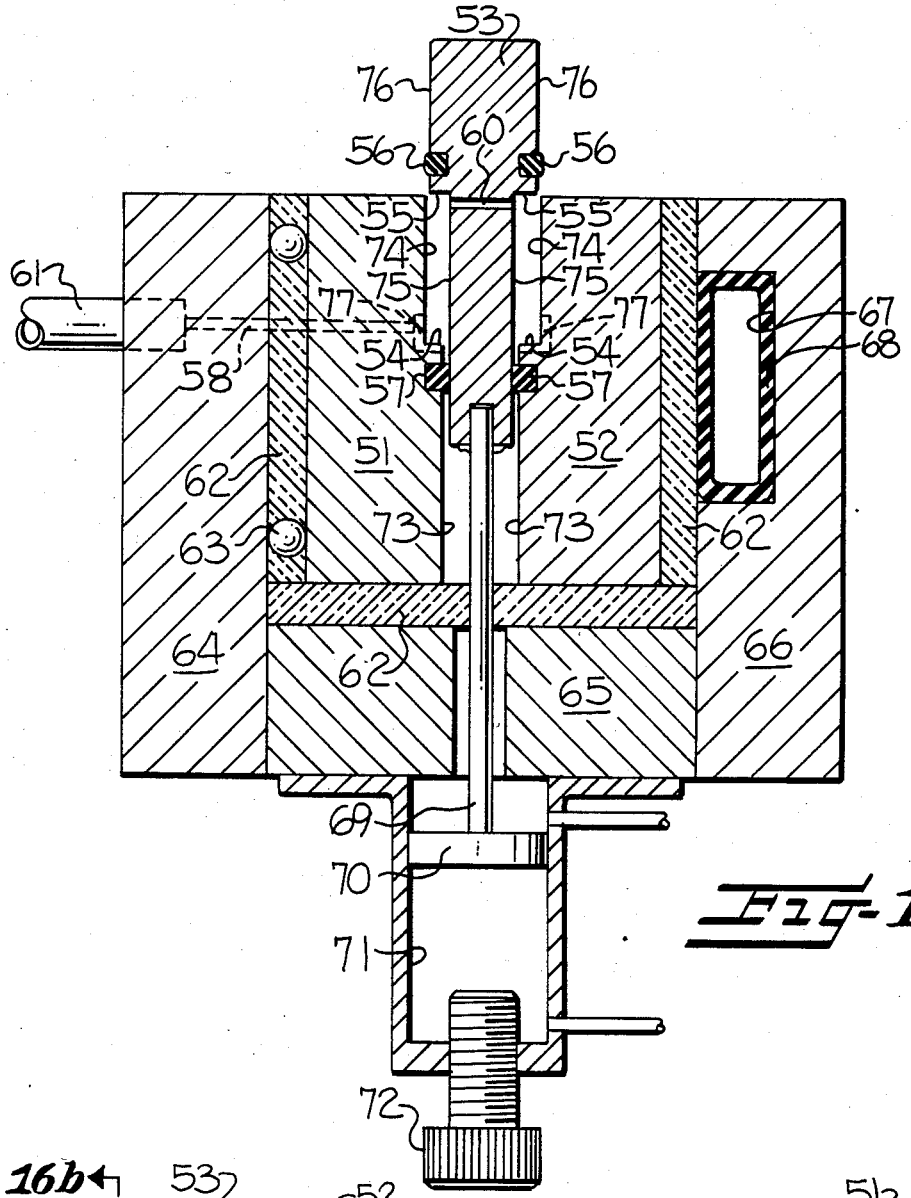
Figure 16A:
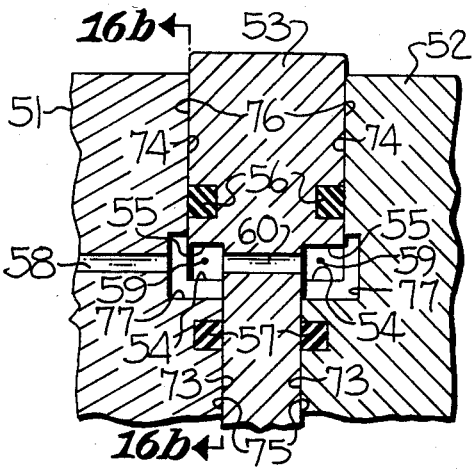
Figure 16B:
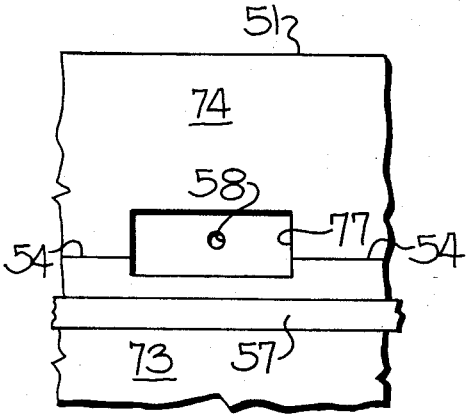
Figure 17A:
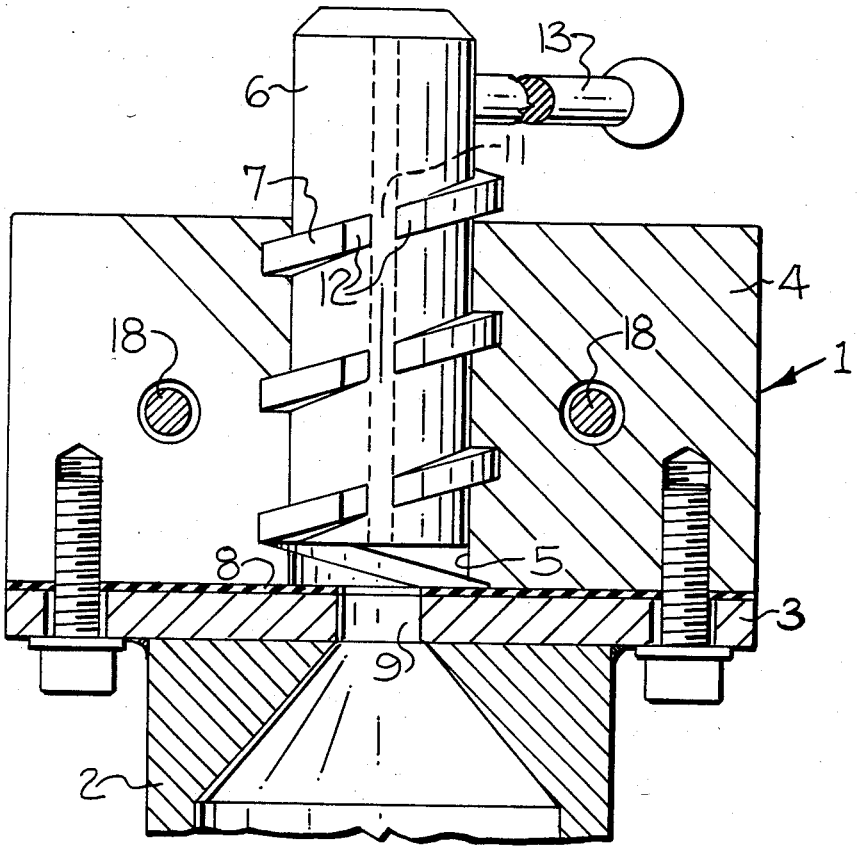
Figure 17B:
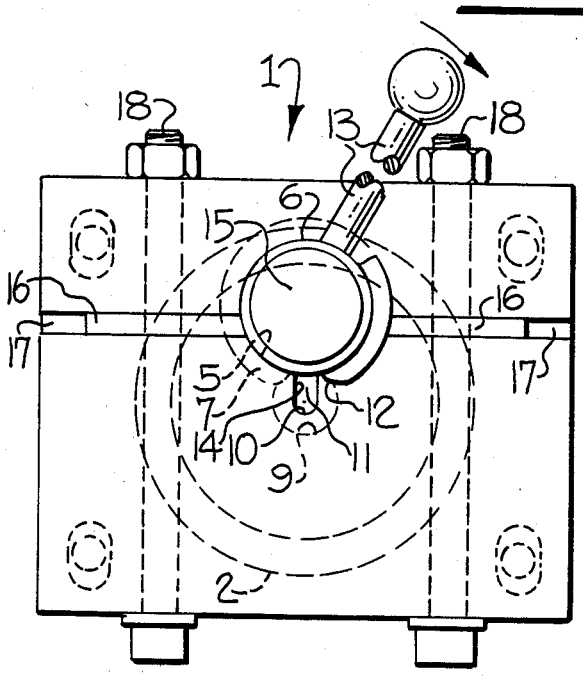
Figure 17C:
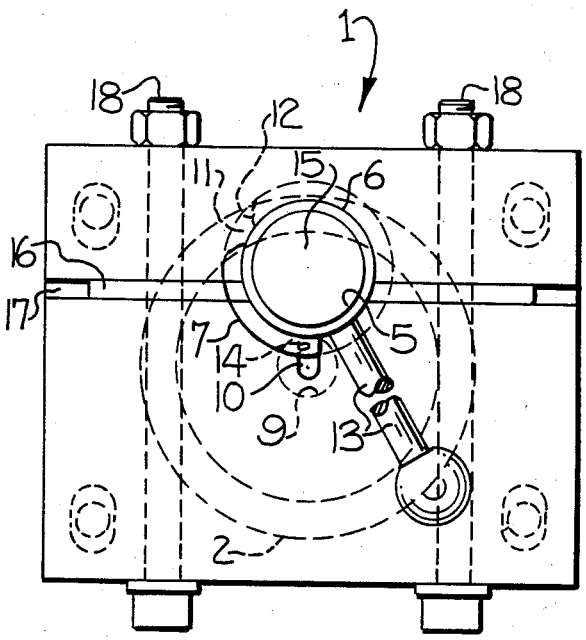

FIGS. 3*a*–3*c* illustrate heating chambers according to the present invention and which consist of plates that slide on each other;

FIGS. 4–6 illustrate heating chambers according to the present invention and which consist of an inner cylinder and an outer sleeve, with a yarn groove in the inner cylinder and a threading groove in the outer sleeve;

FIGS. 7–9 illustrate heating chambers consisting of an inner cylinder and outer sleeve, with a yarn groove in the inner cylinder and an insertion slot in the outer sleeve;

FIGS. 10–14 illustrate embodiments of a design consisting of an inner cylinder and an outer sleeve, and which includes inserts along the yarn groove in the inner cylinder;

FIGS. 15, 16*a* and 16*b* illustrate an embodiment consisting of stepped plates displaceable in relation to each other; and FIGS. 17*a*–*c* illustrate an embodiment which involves separate closures at each end of the heating chamber.

Figure 18A:
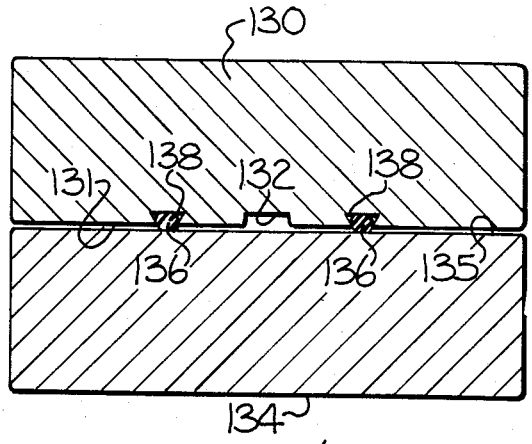
Figure 18B:
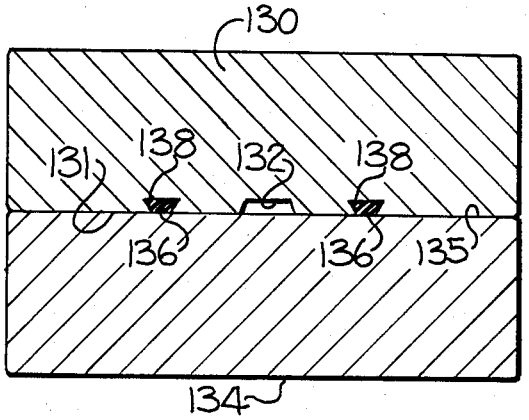

FIGS. 18*a* and 18*b* are schematic cross sectional views illustrating the structural relationship of the mating surfaces of the two members of a heating chamber in accordance with the present invention, with FIG. 18*a* illustrating the surfaces to be in contact, and FIG. 18*b* illustrating a small gap between the surfaces.

Figure 19A:
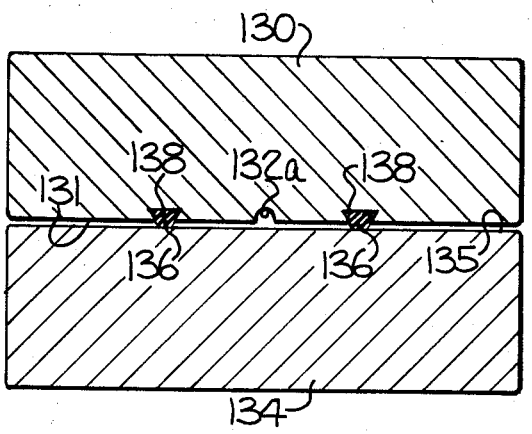
Figure 19B:
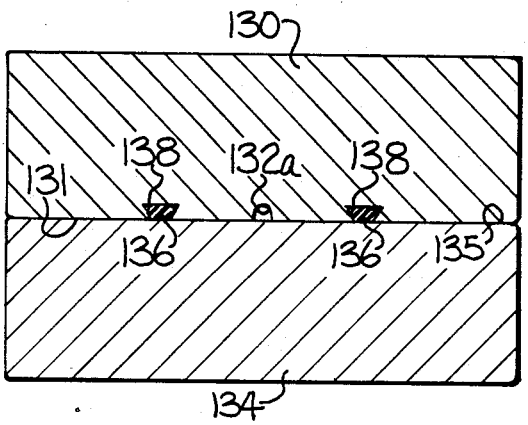
Figure 20:
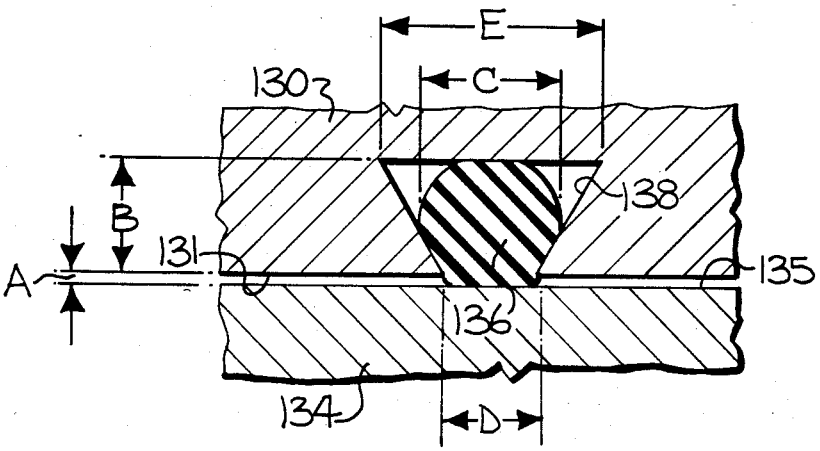

FIGS. 19*a* and 19*b* are generally similar to FIGS. 18*a* and 18*b*, but illustrating a yarn passage of different configuration; and FIG. 20 is a schematic cross sectional view of one of the sealing strips and its receiving groove.

In the embodiments of FIGS. 1–16, the pressurized heating chamber of the present invention is formed over its entire length by only two members, which equally form the intermediate heating area and the sealing end portions of the heating chamber.

A special advantage of the present invention is that the yarn can be threaded simply, quickly and safely, and that the sealing system, in particular, the sealing strips, and the contact of the bodies of the heating chamber, accomplishes not only a complete sealing effect, but also good heat conductivity. The easy threadability and complete sealing makes it possible on one hand that the narrow gaplike end areas can be very narrow (only defined by the yarn denier) and have any desired length. Thereby an escape of vapor is almost entirely avoided.

Pressures of the saturated water vapor with temperatures up to more than 200° C., as well as a constant increase of the vapor pressure from atmospheric pressure to operating pressure, and of the vapor temperature for the incoming yarn are made possible with the present invention, as is a constant decrease of the pressure to atmospheric pressure and of the temperature of the exiting yarn. The steady decrease of the vapor pressure also eliminates the risk of a vapor current which may damage the yarn.

The heating chamber of the present invention serves in particular the purpose of directly heating a traveling yarn by a hot vapor under pressure. Saturated water vapor has been found particularly favorable. For this reason, this application particularly refers to saturated water vapor, which is not intended to limit the applicability of the heating chamber.

Figure 1:
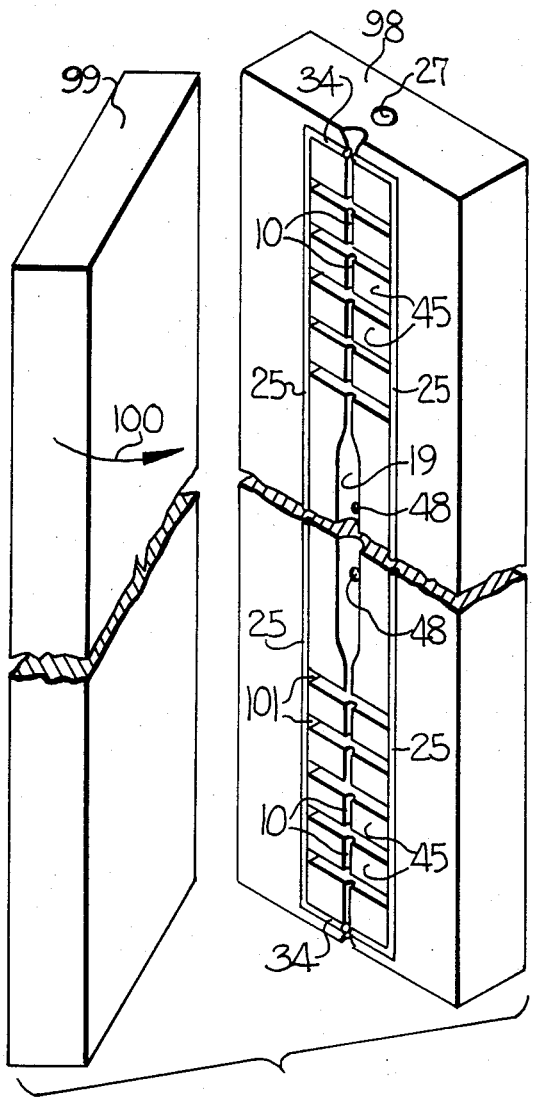
FIG. 1 is a perspective view of a heating chamber embodying the present invention and consisting of flat plates with a thread groove passage that is framed laterally and at each end by sealing strips.

FIG. 1 shows a heating chamber, which consists of the two flat plates 98 and 99. A wide channel is machined into plate 98, into which inserts 45 are placed.

Each of these inserts 45 is provided with a yarn guide groove 10, whose width is suited to that of the yarn being processed, and may be, for example, 0.2 mm. The inserts are enclosed on both sides by longitudinal sealing strips 35 and by a transverse sealing strip 34 at the ends. A bore 27 extends through plate 98, which serves as a vapor supply duct. The central portion 19 of the yarn guide groove or passage is connected with this yarn supply duct via holes 48.

Plate 99 is connected with plate 98 by, for example, a hinge (not shown), so that it can be pivoted in the direction of arrow 100. In the closed position, yarn guide grooves 10 and 19 form a yarn treatment chamber, which may be supplied with, for example, saturated water vapor through supply duct 27.

As illustrated in FIG. 1, the inserts are arranged in spaced apart relation and include expansion gaps 101 between them. However, the inserts may also abut each other. The inserts are advantageous, since they can be inexpensively mass produced and easily replaced when worn, or replaced by inserts with larger duct widths, when the denier of the yarn to be treated is changed. The outlets of the yarn guide grooves 10 of each insert 45, as seen in the direction of the outflowing vapor, are preferably rounded, so that the flow energy of the vapor current diverted by the Coanda effect is always destroyed upon impact on the side wall of the following insert.

Figure 2:
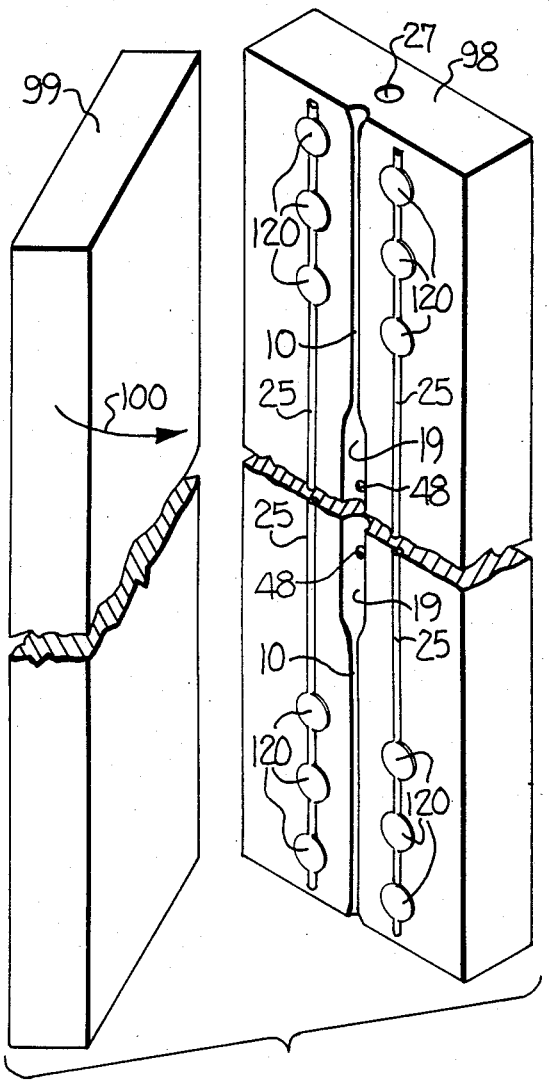
FIG. 2 is a perspective view of another embodiment of the invention, and wherein the sealing strips include enlargements at each end.

In the embodiment of FIG. 2, the sealing strips 25 extend into the separating zone between the two members 98, 99 on both sides of the yarn guide groove. The length of the sealing strips is preferably the same as the length of the yarn guide groove. However, it can also be slightly shorter. The sealing strips are inserted into grooves, so that they do not fall out, when the yarn chamber is opened, and so that they are not able to shift in the separating zone when the members move relative to each other. Finally, it is provided that a longitudinal movement of the sealing strips is precluded in that the sealing strips are widened at their both ends, and inserted into correspondingly widened portions of the receiving grooves. This arrangement precludes thermically conditioned changes in length, and in addition, the widenings seal at least in part the separating zone between the members in the direction of the yarn inlet and yarn outlet. The grooves with their sealing strips are preferably arranged in the stationary member, which also is preferably the yarn guiding member.

FIG. 3*a* shows a cross-sectional view of a heating chamber, which likewise consists of two plates 51 and 53. These plates are adapted to be displaced relative to each other and parallel to their surface by a cylinder-piston assembly 69–71. In the one end position, front edge 105 of plate 51 recedes behind yarn guide groove 10, so that an opening is created into which the yarn can be laterally inserted. In the other relative position shown in dashed lines, the yarn guide groove is covered and closed. In the closed condition, yarn guide groove 10 is supplied with saturated vapor, through vapor supply line 80, via bore 58, by opening a valve not shown here. Vapor is also supplied to the back side of plate 53 through bore 103. As a result of this, plate 53, which is sealed in the housing 104 by continuous seals 49, is pressed against the other plate 51, so that these plates come to abut impermeably to vapor by reason of their sealing strips 56, 57. It is here particularly important that the surface area defined on the rear side of the plate 53 between the sealing strips 49 is greater than the surface area formed between the longitudinal sealing strips 56, 57.

A similar embodiment is shown in FIG. 3*b*, which differs in principle from that of FIG. 3*a* only in that the front side of plate 51 is provided with a step 108.

The embodiment in FIG. 3*c* is also essentially similar, but differs in that plate 51, when in the one end position, does not expose a yarn threading slot above the yarn guide groove, but it has an enlarged longitudinal groove 109, which, in the illustrated position in which the heating chamber is inoperative, is aligned with the yarn guide groove 10 and forms a widened yarn threading gap. Threading groove 109 is beveled on one side, so that when plate 51 is shifted to its operating position shown in interrupted lines, the yarn is pushed by this beveled surface into yarn guide groove 10.

In all these embodiments it is necessary that housing 104, which surrounds plates 51, 52 forming the heating chamber, be sufficiently stable and rigid, on at least two opposite sides, or all sides thereof as shown in FIG. 3*c*, so as to absorb the vapor forces. Also, the housing 104 should ensure that the plates closely abut each other with their contact surfaces and engage their longitudinal and transverse seals when under the load of the vapor pressure.

The embodiment of FIGS. 4–6 shows an inner member or cylinder 6 which is firmly connected with flange 3, and an outer member or sleeve 4 rotatably arranged around it with handle 13. The inner member 6 possesses a yarn guide groove 10 extending over its entire length. In its central area 19, this yarn guide groove is so widened in the circumferential direction and width that a heating chamber is provided in which the yarn can travel, oscillate and balloon without contacting the walls. The outer sleeve 4 possesses a groove 11 which is provided in its inside wall, and the groove 11 has flanks 12 which gently slope from the groove bottom toward the inside wall. Flange 3 is provided with an opening 20, the front area 21 of which, as shown in FIG. 5, is aligned with the yarn guide groove 10. The flanks 22 of the opening 20 thus are aligned with the flanks of yarn guide groove 10, as is illustrated in plan view in FIGS. 5 and 6. The outer sleeve 4 is divided and so secured by flanges 23 and bolts 24 that its inside wall firmly embraces the outside wall of the inner member 6. Longitudinal sealing strips 25 are provided on opposite sides of yarn guide groove 10 in the inner body 6, which seal the yarn guide groove or, respectively, also its central section 19 in circumferential direction. An elastic spacer plate 26, for example, a sealing plate, may be inserted in the separating plane of the divided outer member 4.

A bore 27 extends centrally through the inner member 6, which is closed at the upper end and communicates at the lower end with connection tube 28. Through connection tube 28, bore 27 receives a heated vapor under pressure, in particular saturated water vapor. Bore 27 is further connected with yarn guide groove 10, in its central area 19, through holes 29. In operation, an axial force is applied to the outer member 4 in direction of arrow 30 (FIG. 4). For this purpose a trapezoidal (buttress) thread 31 is provided, which is arranged in the upper portion of outer member 4 and inner member 6. By rotating the outer member 4 relative to the inner member 6 by means of handle 13, outer member 4 is sealingly pressed against sealing plate 8 on end flange 3. In this rotated position, groove 11 of outer member 4 is brought to the position shown in FIG. 6. Thus, groove 11 is located behind the sealing strips 25 so that the saturated vapor cannot enter into groove 11. The yarn guide groove 10 is reduced by the inside wall of the outer member 4 to a very narrow gap, which prevents uneconomically large quantities of the pressurized vapor from escaping. The gap widths are in an order of less than about 0.5 mm.

When the outer member is rotated to the position shown in FIG. 5, groove 11 of the outer body reaches a position in which it covers, in vertical direction, the opening 20 in flange 3, and, in radial direction, the yarn guide groove 10. In this manner, a wide threading opening is provided, through which the yarn can be threaded pneumatically or also with the use of a bristle or a similar means.

The embodiment illustrated in FIGS. 7–9 largely corresponds with that of FIGS. 4–6. The heating chamber consists of a tube-like inner member 6 with a yarn guide groove 10. The yarn guide groove 10 is narrow both at the yarn inlet 1 and at the yarn outlet, and widens in its central area 19. The inner member 6 is fixedly mounted on flange 3, and it receives a saturated water vapor via a central bore 27 from a vapor supply line 28. The water vapor can exit through holes 29 into the widened portion 19 of the yarn guide groove 10. The cylindrical inner member 6 is surrounded by a cylindrical outer member or sleeve 4, which possesses a slot 32 for laterally inserting the yarn. The outer member 4 is surrounded by bands 33 for an increased stability, and can be rotated with handle 13.

In the position shown in FIG. 8, the yarn inserting slot 32 is aligned radially at yarn guide groove 10. It should be noted that the inserting slot can also extend in a manner ranging from a secant to a tangent. In a second rotated position, as shown in FIG. 9, the inside wall is so rotated that the yarn guide groove 10 is again covered by the inside circumference of the sleeve 4.

Another characteristic in comparison with the embodiment of FIGS. 4–6 resides in that the inner member 6 possesses, in addition to the longitudinal sealing strips 25, also transverse seals 34 at both the yarn inlet and the yarn outlet. These transverse seals may be O-shaped sealing strips, which reach from one longitudinal seal to the other. However, it may also be an O-ring, which encloses the entire inner member 6.

Furthermore, and as shown in FIGS. 8 and 9, the inner member possesses on its back side longitudinal sealing strips 35 as well as a transverse seal (corresponding to transverse seal 34 on the front side) respectively arranged at the yarn inlet and yarn outlet. The surface between these longitudinal seals 35 and their transverse seals receives, via a duct 36, the pressurized heating vapor from a tube 27. Since the secant distance between the longitudinal sealing strips 35 on the back side of inner member 6 is larger than the secantial distance between the sealing strips 25 on the front side of inner member 6, in the operative position as shown in FIG. 9, the vapor pressure pushes the movable outer member 4 against the longitudinal sealing strips 25 on the front side in direction of arrow 37.

Figure 10:
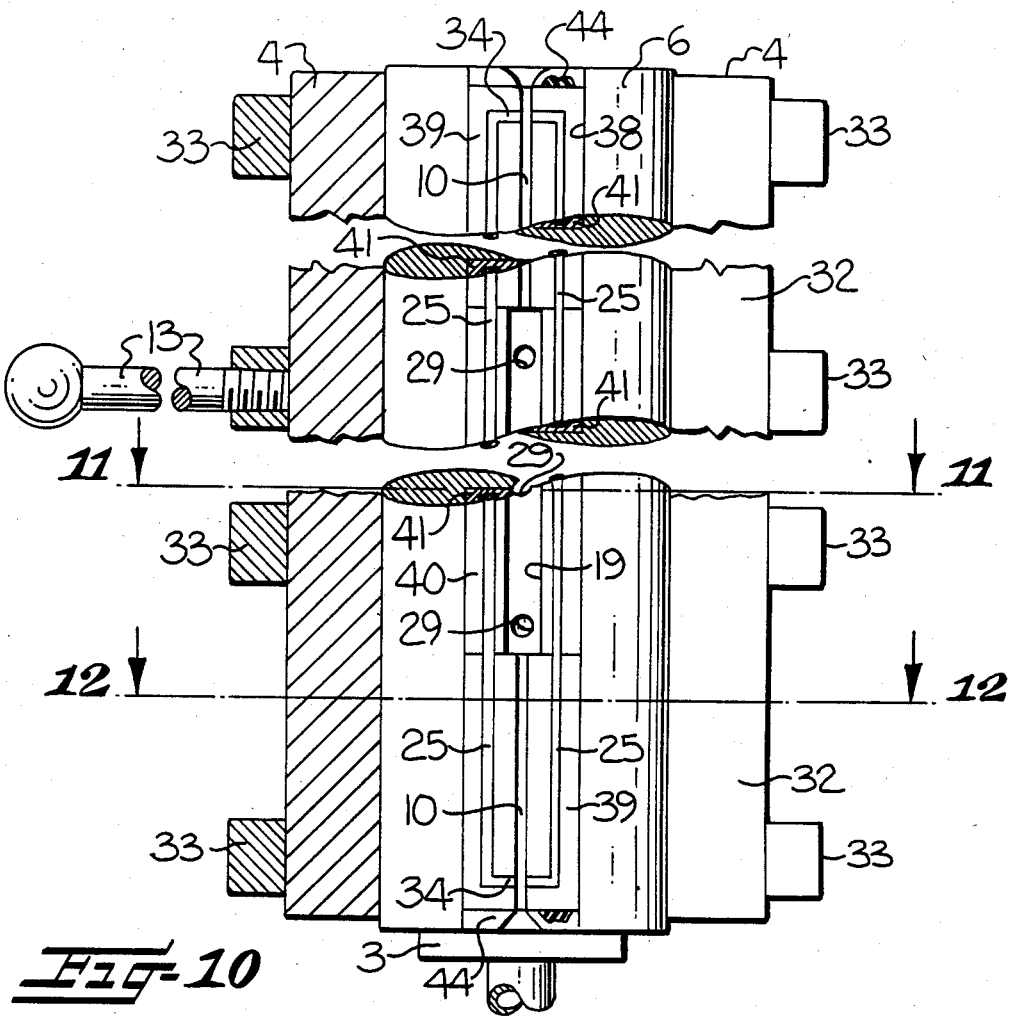
Figure 11:
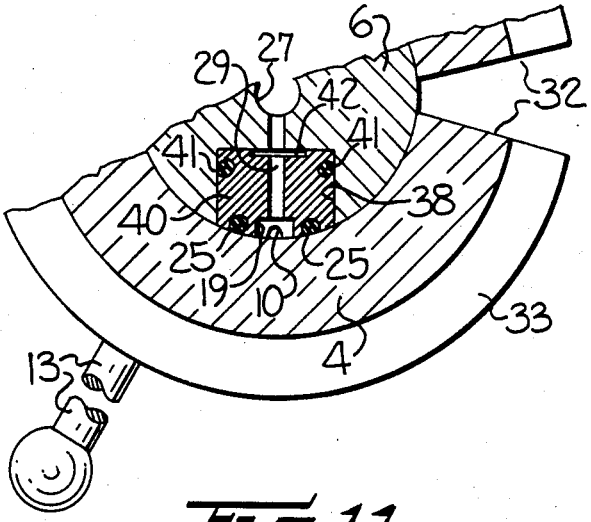
Figure 12:
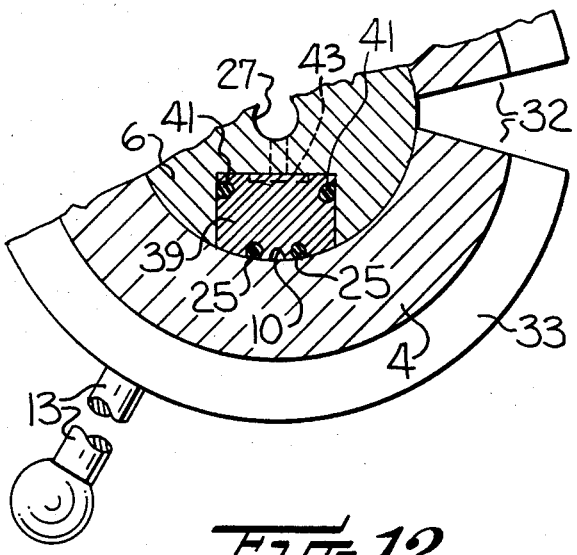

In the embodiments as shown in FIGS. 10–12, flange 3 is again fixedly mounted to the cylindrical inner member 6. The outer member 4 is again designed as a rotatable sleeve 4 with a yarn inserting slot 32, which terminates in the one rotated position (not shown) in the yarn guide groove 10. In the other rotated position shown in FIGS. 11 and 12, sleeve 4 covers yarn guide groove 10.

A channel 38 extending axially from top to bottom is provided in inner member 6, which channel preferably has the same width and depth over its entire length. Channel 38 further contains inserts 39 and 40. Inserts 39 form the yarn inlet portion and yarn outlet portion, and possess a narrow yarn guide groove 10, as shown in FIG. 12. Insert 40 forms the central area of the yarn guide groove and may accordingly, as shown in FIG. 11, possess a yarn guide groove with an enlarged cross section. Inserts 39 and 40 are sealed over their entire length by longitudinal sealing strips 25 extending on opposite sides of the groove. On both sides, the flanks of the inserts are sealed against channel 38 by sealing strips 41. To achieve a certain sealing mobility, the flanks of the insert channel and of the inserts are aligned parallel to each other.

Insert 40 of the central area 19 possesses on its back side a longitudinal groove 42, which communicates with holes 29, and through which the yarn guide groove 10 of the central area 19 communicates with bore 27 for the supply of vapor. Since the secantial distance of the sealing strips 25 on the yarn guide groove side of the inserts 40 is smaller than the secantial distance of the sealing strips 41, insert 40 is pushed by the vapor pressure against the inside wall of the sleeve.

As already described in conjunction with the embodiment of FIG. 7, the inserts 39 are provided with transverse seals 34. The inserts 39 at both the yarn inlet and outlet may, but need not, have a longitudinal groove 43 which is acted upon by vapor pressure. Likewise, it is not absolutely necessary to provide a separate vapor duct to supply vapor to the longitudinal groove 43. Rather, the vapor pressure from the longitudinal groove 42 of insert 40 will also provide for an adequate vapor pressure on the back side of inserts 39. Even though the longitudinal groove 43 is not present, or extends only over a short area from insert 40 toward the yarn inlet or yarn outlet, the vapor pressure forming behind insert 39 is adequate for providing a sufficient pressure for the sealing strips 25 to contact the inside circumference of sleeve 4. In this connection, it should be noted that a current develops in the yarn inlet and yarn outlet corresponding to the drop of pressure, so that the static pressure is greater on the back side of insert 39 than the static pressure on the front side of the insert. Also, in the case of inserts 39, the sealing strips 41 provide that the back side is sealed impermeably to the vapor. As is shown in FIG. 10, the end faces of the inner member 6 are sealed by gaskets 44, which are firmly and sealingly fitted in the circumferential surface of sleeve 4.

The use of transverse seals 34 in the embodiments of FIGS. 7 or 10 makes it unnecessary to press the outer sleeve 4 by axial force against sealing plate 8, as is shown in FIG. 4.

Figure 13:
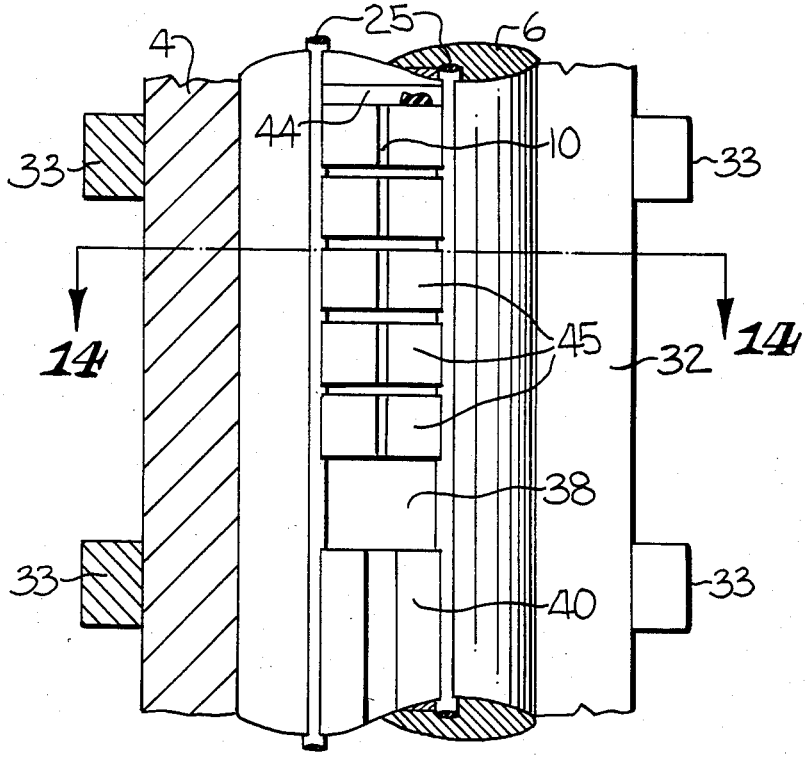
Figure 14:
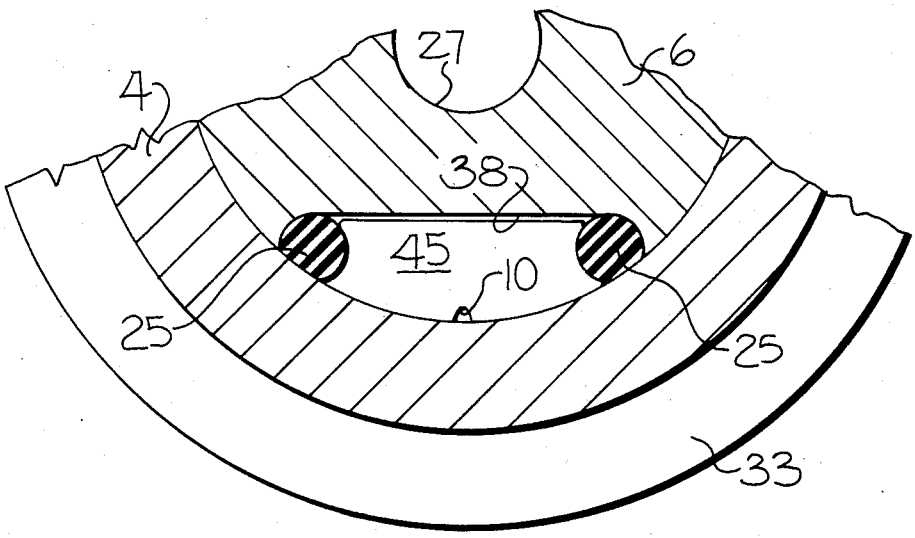

In the embodiment of FIGS. 13 and 14, the yarn inlet and yarn outlet of the heating chamber are in particular formed by relatively thin inserts 45. For this purpose, inner member 6, as is also shown in FIGS. 7 and 10, possesses an insert receiving channel 38. The flanks of this insert channel 38 are convergingly shaped so that they provide a support on both sides of sealing strip 25, note FIG. 14.

In its central area, the heating chamber may also have an insert 40. As can be seen, this insert 40 may also be left out or be replaced with individual, shorter inserts.

Both the inserts 45 and 40 possess flanks which conform to the sealing strips 25. Thus, the inserts can be clamped between the sealing strips 25. Since there is a space between the sealing strips, a static pressure will develop behind the sealing strips, whereas above the sealing strips, a current develops with a corresponding reduction of the static pressure. For this reason, the sealing strips 25 are pressed forwardly against the inner circumference of sleeve 4. In the embodiments of FIGS. 10–14, the inserts may consist of particularly wear-resistant materials, such as, for example, ceramic, in particular sintered ceramic, or also sinter metal. The advantage of this embodiment is that the inserts, when worn or when the yarn denier is changed, can be easily removed. Furthermore, the inserts can be mass produced, and a wide channel in the inner member 6 is simpler and less costly to provide than a very fine yarn guide groove.

FIG. 15 shows a double yarn heating chamber. The yarn heating chambers consist of plates 51, 52 and 53. The pair of plates 51 and 53, and the pair of plates 52 and 53 each form one yarn heating chamber.

Each plate 51 and 52 possesses the two planar surfaces 73 and 74, which extend parallel to each other and are interconnected by a shoulder 54. Plate 53 can be displaced between plates 51 and 52. Plate 53 also has two planar parallel surfaces 75 and 76, which are interconnected by shoulder 55. Each of the shoulders 54 and 55 of the plates 51, 52 and 53 is of the same size. Also, the shoulders 54 lie in the same plane, as do the shoulders 55 of the plate 53. However, the shoulders can be differently designed. In particular, it is possible to design the shoulders concavely when viewed in cross-sectional view. Plate 53 with its surfaces 75 is slidingly guided between the two surfaces 73 of plates 51 and 52 which face each other. In the position as shown in FIG. 15, a longitudinal slot is created on the front face of plates 51 and 52 in the area of shoulder 55 of plate 53, since this shoulder 55 slightly projects beyond the front face of plates 51 and 52. Through these longitudinal slots a yarn traveling parallel to the longitudinal shoulders can be inserted laterally to its traveling direction, into the gap between plates 51 and 53, or, respectively, 52 and 53. The plate 53 is then pushed back to an operative position, which is shown in FIG. 16*a*. In this position, two narrow, parallel yarn passages are formed. Each yarn passage is defined by plane 74 and shoulder 54 of plate 51 or, respectively 52, and by plane 75 and shoulder 55 of plate 53. Both yarn passages are supplied with saturated vapor through connection 61 and duct 58 as well as intermediate duct 60. For this purpose, as is shown in FIGS. 16*a* and *b* a recess 77 is formed in plane 74 and shoulder 54 of plates 51 and 52, respectively, in the area vapor duct opening 58 and vapor passage duct 60. This recess widens the yarn passage, and serves in this case to let the vapor supplied through duct 58 flow unthrottled through duct 60, so that identical pressure and temperature conditions exist in the two neighboring yarn ducts. However, it is also possible to provide a recess 77 so that it extends over a greater length, and that the narrow gap remains only in the area of the inlet and outlet. It should be noted that the gap width typically amounts to about 0.2 to 0.3 mm, which permits a 167 dtex filament yarn to be treated with a saturated water vapor, without a damaging wall friction, and only slight losses. In such example, the gap length may be only 60 mm on each side of the narrow recess, with vapor supplied at a temperature of 220° C. and a pressure of about 24 bar.

The plate assembly consisting of plates 51, 52 and 53 is entirely surrounded by insulating sheets 62. This assembly is in turn enclosed by plates 64, 65 and 66 so as to form a massive block, which is held together by bolts and is stable enough to absorb the pressures developing in the interior of the yarn treatment chamber and the thus created forces. In order to bias the plate assembly together, a hose 68 is nested in one chamber 67 of plate 66, which hose essentially extends over the entire length of the yarn heating chamber. The hose preferably has an oblong cross section, so that the width at which the hose contacts the side surface of plate 52 is greater than the width of the yarn treatment chamber in operation. Therefore, a pressure, which is reduced by about the surface ratio, can be applied to hose 68, so as to press the plate assembly 51, 52, 53 together and make it impermeable to vapor leakage.

The hose 68 may be connected to a compressed-air system. However, it is also possible to connect hose 68 to the line system of the heated vapor. For this purpose, the hose 68 may be filled with a fluid, to which the pressure of the heated vapor is applied. Balls 63 serve to transmit the forces applied to plate assembly 51, 52, 53 via the hose, to plate 64 of the massive block.

To seal the yarn treatment chamber of FIG. 15, sealing strips 56 and 57 are positioned on surfaces 76 and 73 respectively. These sealing strips are resilient and eliminate the absolute necessity to manufacture the surface pairs 73, 74 of plate 51 and the surface pairs 75, 76 of plate 53 to precise dimensions. The center plate 53 is displaced by a cylinder-piston assembly 70, by means of a piston rod 69. At 72, a stop screw is indicated, which allows the gap width of the yarn treatment chamber to be adjusted during operation.

FIGS. 17*a–c* illustrate an embodiment of the invention wherein the heating chamber comprises an elongate tubular member 2, and which has a yarn inlet 1 mounted at one end of the tubular member. It should be noted that the yarn outlet of the heating chamber can be correspondingly designed. Not shown is the vapor supply duct into the tubular member 2, by which a saturated water vapor is supplied under a pressure of, for example, 20 bar, so that the temperature of the saturated vapor is about 210° C.

Mounted on end flange 3 of the tubular member 2 is an outer member 4, which is fixedly secured to the end flange 3, with, however, a certain relative movement being possible, as will be outlined further below. A seal, not shown, may be placed between end flange 3 and outer member 4.

The outer member 4 includes a cylindrical bore 5 which accommodates an inner member 6 which is designed and constructed as a cylinder with a buttress thread 7. The inner bore 5 includes a cooperating thread, and the cylinder 6 with its threading is adapted as sealingly as possible to the inner bore 5 with its threading. A sealing ring 8 is provided at the bottom of bore 5, which may be the same sealing member which is also placed between end flange 3 and outer member 4.

As is particularly illustrated in FIGS. 17*b* and 17*c*, an opening 9 is provided in end flange 3, through which the yarn leaves the tubular member 2. A corresponding opening is provided in sealing ring 8. The periphery of the bore 5 in outer body 4, when projected in the planes of FIGS. 17*b* and 17*c*, intersects the opening 9. In addition, the periphery of the bore 5 includes a groove 10, which extends in the radial direction through the thread of the bore, and which is axially aligned with opening 9 of the end flange. This groove 10 serves as a yarn guide passage in the operative position. As is shown in perspective view in FIG. 1, inner member 6 possesses a corresponding groove 11 which extends only through the thread 7 to the core of inner body 6, but which may also reach into the core. The flanks 12 of groove 11 are inclined in the manner of a funnel in circumferential direction. The inner member has a handle 13, which permits the inner member 6 to rotate relative to the outer member 4.

In the rotated position as shown in FIG. 17*b*, groove 10 in the inner wall of outer member 4 and groove 11 in the thread and possibly also in the bore of inner member 6 form a wide threading slot, through which the yarn can be inserted. For the purposes of pneumatic threading, the inner wall of tubular member 2 extends in the form of a funnel toward hole 9 in end flange 3.

By rotating the inner member 6 in the direction of the arrow (FIG. 17*b*), the groove 11 in inner member 6 is brought to the position shown in FIG. 17*c*. In doing so, groove 10, which serves as a yarn guide, is reduced to a narrow gap, the width of which is so small that losses in hot saturated vapor and pressure are low. The fact that the flanks 14 of groove 10, which are cut into the thread of the outer member, extend essentially radially, and the fact that the flanks 12 of the groove in the inner member widen in the shape of a funnel, facilitate the movement of the yarn along the flanks 14 into groove 10 when the inner member 6 is rotated.

As is shown in FIGS. 17*b* and 17*c*, the outer member 4 is divided in a plane which extends between the center 15 of the bore 5 and groove 10 in the outer member. The outer member is thereby divided into two components, and a seal 16 in the form of a flat gasket is placed in this separating plane. The seal is elastic and thicker in its relaxed state than the spacers 17. Bolts 18 clamp the two components of the outer member together, after seal 16 and spacers 17 have been inserted. Only then is the thread cut into bore 5 of the outer body 4. In doing so, the seal 16 is also provided with a thread. As a result, the seal 16 seals the thread along both the core and flanks on both sides of groove 10. To allow the required relative movement of the two components of the outer member 4 on the end flange upon retightening, the flange bolts in the longitudinal holes of end flange 3 are slightly movable. Spacers 17 may be made of a relatively soft metal, so that a readjustment of the seal is also made possible by pressing the spacers together. The spacers may also be omitted, but the advantage of their use is primarily that during assembly, the seal may be adjusted without the aid of the technician.

By rotating the inner member 6 relative to the outer member 4, grooves 10 and 11 are no longer aligned, with groove 11 being so far rotated that it comes to lie on the other side of sealing plate 16. By this rotation, the inner member 6 is threadedly advanced into outer member 4 in such a manner that it sealingly rests, with an axial force, against the sealing ring 8.

FIGS. 18*a* and 18*b* illustrate two possible structural relationships for the mating surfaces of the two members in the closed position of the heating chamber. As illustrated, the heating chamber comprises a first member 130, which may for example take the general form of the plate 98 as shown in FIGS. 1 and 2, and which includes a surface 131 having an elongate groove 132 of generally rectangular outline and which defines a passage for the advancing yarn. The second member 134, which may take the general form of the plate 99 of FIGS. 1 and 2, includes a surface 135 which is substantially congruent with the surface 131 of the first member 130. A pair of sealing strips 136 are mounted in receiving grooves 138 which are disposed on respective opposite sides of the yarn passage.

In the illustrated operating position, the two surfaces 131, 135 overlie each other, with the sealing strips 136 being sealably disposed between the surfaces, and the surfaces 131, 135 and strips 136 define a heating enclosure which includes the yarn passage 132. As will be understood, it is not possible as a practical matter to manufacture the surfaces 131, 135 with tolerances so precise that there is contact between all areas of the surfaces. Where there is no contact (as seen in FIG. 18*a*), there is a gap between the surfaces into which the hot vapor may enter and condense, to thereby heat the members to an equal temperature. Where the surfaces are in contact (note FIG. 18*b*), there is good heat transfer and thus an equal temperature in both members.

FIGS. 19*a* and 19*b* illustrate a similar construction, with the configuration of the yarn passage 132*a* being generally circular in cross section, as compared to the generally rectangular passage of FIGS. 18*a* and 18*b*.

FIG. 20 is an enlarged cross sectional view illustrating one embodiment of the sealing strip 136 and retaining groove 138. The groove for the strip is of trapezoidal outline, with the bottom wall having a width E greater than the width D at the outer opening. The strip 136, which is composed of a resilient elastomeric material, has a circular cross sectional outline and a diameter C which is greater than the width D of the groove at the opening, so as to be retained therein. Also, the diameter C of the strip is greater than the depth B of the groove so that in its relaxed condition the strip extends outwardly from the surface a distance within the elastic deformability of the strip. As a specific example, the structure may have the dimensions as follows:

A=0.1 to 0.3 mm
B=2.8 mm
C=3.5 mm
D=3 mm
E=4.2 mm.

In the drawings and specification, there has been set forth preferred embodiments of the invention, and although specific terms are employed, they are used in a generic and descriptive sense only and not for purposes of limitation.

That which is claimed is:

1. A heating chamber for thermally processing an advancing yarn, and comprising a first member including a surface having an elongate discontinuity therein which extends in a longitudinal direction, a second member including a surface which is substantially congruent with said surface of said first member, means mounting said first and second members for relative movement between an operative position wherein the respective surface overlie each other and said surface of said second member and said discontinuity define a relatively narrow yarn passage formed therebetween for completely and closely surrounding the yarn along substantially the entire length of said heating chamber, and a threading position wherein said surface of said second member is positioned relative to said discontinuity to define an enlarged opening to facilitate threading of the yarn, a pair of sealing strips mounted on at least one of said surfaces of said first and second members, said sealing strips being disposed on respective opposite sides of said discontinuity in said operating position of said members and extending longitudinally along substantially the entire length thereof and so that in said operating position said sealing strips are sealably disposed between said surfaces, and said surfaces and said sealing strips define a heating enclosure which includes said discontinuity, and means for introducing a hot pressurized vapor into said heating enclosure when said members are in said operating position, whereby the hot vapor is adapted to enter into the gap between any noncontacting portions of the surfaces of said members lying between said sealing strips to thereby achieve substantial heat transfer.

2. The heating chamber as defined in claim 1 further comprising a transverse sealing strip mounted on at least one of said surfaces and adjacent each end of said discontinuity, with said transverse sealing strips extending substantially between said longitudinal sealing strips, whereby the ends of said heating chamber are substantially sealed by said transverse sealing strips.

3. The heating chamber as defined in claim 2 wherein said longitudinal and transverse sealing strips are mounted within a substantially continuous groove formed in one of said surfaces, and wherein said groove is somewhat more shallow than the thickness of said sealing strips so that in their relaxed condition said strips extend outwardly from said surface a distance within the elastic deformability of said strips.

4. The heating chamber as defined in claim 3 wherein said substantially continuous groove has a generally trapezoidal outline in cross section and so that the outer opening is less wide than the bottom surface, and wherein said sealing strips have a generally circular outline with a diameter greater than the width of the opening of said groove, and whereby the groove acts to retain the sealing strip therein.

5. The heating chamber as defined in claim 3 wherein said longitudinal and transverse strips are arranged to define a rectangular outline.

6. The heating chamber as defined in claim 1 wherein one of said first and second members includes a rear surface facing opposite said first mentioned surface, and further comprising duct means for introducing a portion of said hot pressurized vapor onto said rear surface so as to bias said one member toward the other member in the operative position thereof.

7. The heating chamber as defined in claim 6 further comprising a pair of longitudinal sealing strips extending along respective opposite sides of said rear surface of said one member, with the lateral spacing between said pair of strips on said rear surface being greater than the lateral spacing between said pair of sealing strips on said one surface.

8. The heating chamber as defined in claim 1 wherein said first and second members each comprise a plate, with said surfaces thereof being generally flat, and wherein said discontinuity in said first member comprises a yarn receiving groove in said surface thereof, and wherein said means mounting said first and second members permits relative movement in a direction generally perpendicular to said surfaces.

9. The heating chamber as defined in claim 8 wherein said sealing strips are mounted in associated grooves in said surface of said first member and extend along respective opposite sides of said yarn receiving groove, and further comprising transverse sealing strips mounted in associated grooves in said surface of said first member adjacent each end of said heating chamber.

10. The heating chamber as defined in claim 9 wherein said sealing strips collectively form a closed rectangular outline.

11. The heating chamber as defined in claim 9 wherein said transverse sealing strips comprise laterally extending enlargements which are integrally formed with said first mentioned sealing strips.

12. The heating chamber as defined in claim 1 wherein said first and second members each comprise a plate, with said surfaces thereof each being generally flat, and with said discontinuity in said first member being in the form of a groove in said surface thereof, and wherein said means mounting said first and second members permits relative movement along the direction of said surfaces and transverse to the direction of said groove in the surface of said first member.

13. The heating chamber as defined in claim 12 wherein in said threading position said second member is laterally withdrawn from said groove in the surface of said first member so as to permit a yarn to be laterally inserted into said groove.

14. The heating chamber as defined in claim 12 wherein said second member includes a groove in the surface of the associated plate which extends in a direction parallel to said groove in said first member and wherein in the operative position the grooves are laterally offset so that only one of the grooves forms the yarn passage, and in the threading position the grooves are aligned with each other to form the enlarged opening.

15. The yarn heating chamber as defined in claim 1 wherein said second member is a rigid tubular sleeve having a cylindrical bore, and said first member is a cylinder disposed coaxially in said bore of said tubular sleeve, and wherein said means mounting said first and second members permits relative rotational movement thereof about their common axis.

16. The yarn heating chamber as defined in claim 15 wherein said discontinuity in the surface of said first member comprises an axial groove extending along the complete length of said cylinder, and said second member includes an axial groove extending along at least a portion of said bore of said tubular sleeve, and wherein in the operative position the grooves are circumferentially offset so that only the groove in said first member forms the yarn passage, and in the threading position the grooves are aligned with each other to form said enlarged threading opening.

17. The heating chamber as defined in claim 16 wherein said groove in said second member comprises a slot extending through the wall of said tubular member along the entire axial length thereof and so as to permit a yarn to be laterally threaded into said groove of said first member when said members are in the threading position.

18. The heating chamber as defined in claim 1 wherein said first and second members are each in the form of a plate, with said discontinuity of said first member comprising a shoulder, and with said surface of said second member having a conforming shoulder which is opposed to the shoulder of said first member, and wherein said means mounting said first and second members permits relative movement along a direction parallel to the direction of the surfaces and perpendicular to said shoulders so that said shoulders are closely spaced apart in the operative position and widely spaced apart in the threading position.

19. The heating chamber as defined in claim 18 wherein in said threading position one of said shoulders is laterally separated from the surface of the other member so as to permit a yarn to be laterally inserted between the shoulders.

20. The heating chamber as defined in claim 18 wherein one of said sealing strips is mounted on the surface of said first member and the other of said sealing strips is mounted on the surface of said second member.

21. The heating chamber as defined in claim 1 wherein said heating chamber further comprises an elongate tubular member, and a first pair of said first and second members are disposed at one end of said tubular member and a second pair of said first and second members are disposed at the other end of said tubular member, and with the yarn passages of said two pairs of first and second members communicating with the internal bore of said tubular member.

22. The heating chamber as defined in claim 21 wherein said internal bore of said tubular member has a relatively wide cross section, and wherein said heating means comprises a vapor supply duct communicating with said internal bore of said tubular member.

23. The heating chamber as defined in claim 22 wherein said first member comprises a block-like solid having a cylindrical bore therethrough which has an axis disposed generally parallel to the axis of said tubular member, and said surface of said first member comprises the inner wall of said cylindrical bore and said discontinuity comprises a longitudinal groove formed in the inner wall of said cylindrical bore, and wherein said second member comprises a cylinder disposed coaxially in the bore of said first member.

24. The heating chamber as defined in claim 23 wherein said first member is composed of two components which are separated along a plane which is parallel to the axis of said bore and located between said groove and said bore and the axis of said bore, and said pair of sealing strips is mounted between said components with each strip communicating with said bore along the longitudinal length thereof.

25. The heating chamber as defined in claim 16 wherein said first member includes an axially extending channel formed in the exterior surface thereof, and at least one insert positioned in said channel, with each insert including an outer surface facing said bore of said sleeve and having at least a portion of said groove formed therein, and with each insert further including an oppositely facing inner surface.

26. The heating chamber as defined in claim 25 wherein said pair of sealing strips include portions which are mounted to said at least one insert on opposite sides of said portion of said groove formed in said insert.

27. The heating chamber as defined in claim 26 further comprising duct means for introducing a portion of said hot pressurized vapor between said inner surface of said at least one insert and the opposite surface of said channel so as to bias said insert toward said bore of said sleeve in the operative position thereof.

* * * * *